United States Patent [19]

Demianczuk et al.

[11] 4,405,381

[45] Sep. 20, 1983

[54] STEEL PRODUCTS SUCH AS BARS, COMPOSITIONALLY NON-RIMMING AND INTERNALLY ALUMINUM KILLED, HAVING GOOD SURFACE CONDITION

[75] Inventors: Dionisyj W. Demianczuk, Parma; Carl J. Bingel, Fairview Park, both of Ohio

[73] Assignee: Republic Steel Corporation, Cleveland, Ohio

[21] Appl. No.: 296,637

[22] Filed: Aug. 27, 1981

Related U.S. Application Data

[63] Continuation of Ser. No. 121,879, Feb. 15, 1980, abandoned.

[51] Int. Cl.[3] ..... C21D 8/06

[52] U.S. Cl. ..... 148/2; 148/12 B; 148/39

[58] Field of Search ..... 148/2, 12 R, 12 B, 12.1, 148/39, 36; 75/129, 58, 53; 164/56.1

[56] References Cited

U.S. PATENT DOCUMENTS

| | | | |
|---|---|---|---|
| 2,389,516 | 11/1945 | Kinnear | 22/206 |
| 3,102,831 | 9/1963 | Tisdale | 148/12 F |
| 3,414,042 | 12/1968 | Behrens et al. | 164/57 |
| 3,521,695 | 7/1970 | Diener et al. | 75/129 |
| 3,590,476 | 7/1971 | Levy et al. | 29/527.7 |
| 3,725,049 | 4/1973 | Satoh et al. | 75/129 |
| 3,726,724 | 4/1973 | Davies et al. | 148/36 |
| 3,741,822 | 6/1973 | Gorton | 148/36 |
| 3,951,645 | 4/1976 | Luyckx et al. | 75/58 |
| 3,960,615 | 6/1976 | Breedijik | 148/36 |
| 3,990,497 | 11/1976 | Perie | 164/56 |
| 4,092,179 | 5/1978 | Charpentier et al. | 148/2 |
| 4,143,211 | 3/1979 | Obinata et al. | 75/58 |

*Primary Examiner*—Peter K. Skiff

*Attorney, Agent, or Firm*—Cooper, Dunham, Clark, Griffin & Moran

[57] ABSTRACT

Steels such as standard carbon or alloy types that have too much carbon, i.e. 0.15% or (notably) more, to be rimmed, are produced in improved form by pouring a base melt of such steel which includes manganese up to 1.75% and other alloying elements if desired, and is sufficiently deoxidized, as with Si or Al, to be partially killed but not fully killed. Such pouring in an ingot mold is initially up to 80 to 95% full, under circumstances such that a shell solidifies, and pouring is continued, while adding into the still-molten core sufficient aluminum at least to kill the core and also as desired, other alloying or useful elements. The solidified ingot ultimately yields hot rolled bar products which are essentially aluminum-killed steel but have a partially killed skin and have superior surface conditions lacking blow holes, and being very appropriate for bar stock.

5 Claims, No Drawings

STEEL PRODUCTS SUCH AS BARS, COMPOSITIONALLY NON-RIMMING AND INTERNALLY ALUMINUM KILLED, HAVING GOOD SURFACE CONDITION

This is a continuation of application Ser. No. 121,879 filed Feb. 15, 1980, abandoned.

BACKGROUND OF THE INVENTION

This invention relates to aluminum-treated steel products, i.e. non-rimming steels to which aluminum has been added for killing or grain refinement, or both, and which nevertheless are not seriously characterized by the surface defect problems often caused by the presence of aluminum at or near the surface of an ingot, bloom, slab or the like. As will be understood, such problems chiefly arise from inclusions constituted of aluminum oxides or nitrides, but in any case, the present invention reduces or avoids significant aluminum content in the skin of the ingot (which is wholly non-rimmed, both skin and core) while maintaining adequate concentration for desired purposes in the main body or core of steel and of products rolled from such ingot.

As noted above, the invention is chiefly concerned with steels of non-rimming character, particularly compositions outside the usual rimming range, as by inclusion of higher amounts of carbon or manganese, or both, as well as possibly other elements, e.g. silicon, nickel, chromium, which might also interfere with rimming action. In particular, having regard to the fact that steels basically cannot exhibit the effervescent rimming action when containing substantially more than or even as much as 0.15% carbon or substantially more than about 0.65% manganese, the invention is primarily related to non-rimming steel, and in one preferred aspect further contemplates that the base composition, in unkilled state as first melted, should be such, as to deoxidation, that formation of blow holes at or near the surface of the ingot is inhibited. In any case, the invention provides a new product and a relatively simple and effective way of making such product, to achieve the conditions and circumstances noted above, especially for steels to be processed into bar products, for which there is great concern in regard to ingot or bloom defects.

Prior art has been noted that describes the production of steel having an outer skin of rimmed steel and a core which is killed with aluminum. Such products have been attained by taking a melt of rimming steel, pouring each ingot mold partly full, allowing the metal to rim while a skin solidifies next to the mold wall, and thereafter completing the fill of the mold with the same molten steel, while adding aluminum. This final or back-filling step mixes into the molten core, the ultimate result being an ingot that has a skin of rimmed steel and a core of killed steel which otherwise has the same composition.

Some more recent inventions in this area have related to addition of other and special alloying materials, at the time of back-filling, so that the core becomes characterized not only by a killed state, but by greater strength, toughness or the like, as may be contributed by the alloying elements. In general, these other developments, wherein the core has been killed by aluminum addition, have contemplated the attainment of a rimmed steel skin surrounding the core, it being conceived that such type of skin is necessary in order to achieve significant avoidance of skin defects, and indeed such nature of the skin has been especially desirable where the steel was processed, by ultimate cold rolling and annealing, to achieve a true deep-drawing grade.

The foregoing prior or other developments have included not only disclosures in prior patents, but also some presently developed inventions which are the subject of other patent applications. Attention has also been given to U.S. Pat. No. 3,590,476, Bernard S. Levy et al., issued July 6, 1971, which describes a method, and resulting steel products, wherein addition of tellurium or equivalent element for increasing machinability, is injected into the molten core of a freshly poured ingot after a surrounding steel skin has solidified. This patent purports to deal with various kinds of steel, including those with too much manganese to rim, and contemplates one method in which the ingot mold is partly filled, then left to solidify the non-rimming skin; thereafter, filling is completed while adding the desired tellurium or equivalent. The sole purpose of the described method and constitution of the product is to avoid a surface defect (after hot rolling) caused by tellurium and known as "surface checking", said to be manifested by a large number of small surface cracks, which render the article commercially unacceptable. The only concern of the Levy et al. method and product is to avoid this surface checking on the hot rolled product, i.e. in the special situation of addition of tellurium, selenium or lead, which may cause the trouble; no other compositions or problems are considered or discussed.

The present invention is directed to different areas from the foregoing prior art, especially in making steel, for bar stock, which is basically non-rimming, while the process and product are nevertheless such as to involve relatively superior surface conditions of the ingot or the immediately rolled articles. The chief aim of the product is to achieve an aluminum-treated composition, i.e. to produce a fully aluminum-killed steel or an aluminum-grain refined steel, or both, while avoiding certain common defects resulting from the addition of aluminum. Moreover, the products of the invention, for example by reason of suitable compositional control, are preferably devoid of so-called blow holes, as sometimes undesirably occur at or near the surface or skin of a rimmed or otherwise non-deoxidized ingot.

SUMMARY OF THE INVENTION

To the foregoing and other ends, it has been discovered that improved, rolled steel products, especially bar products (whether round, square or other cross-sectional shape) made by hot rolling, or corresponding billet or bloom stock appropriate for rolling to bar shapes, can be produced by a method in which a base melt is first prepared, as in open hearth or preferably basic oxygen type furnaces, such melt being of non-rimming character, but nevertheless not skilled as by the inclusion of sufficient aluminum, silicon or the like. Thus, such a base melt of steel may contain 0.15% or more carbon, i.e. 0.15 to 0.9% C, and 0.3 to 1.75% manganese, with customary limits of phosphorus and sulfur as in corresponding standard steels, e.g. 0.04 max. % P and 0.045 max. % S. In addition, other elements such as nickel, chromium and molybdenum may or may not be included as in percentages in the ranges up to 0.5 to 2.0%.

The melt of steel so composed is then teemed into the ingot molds, i.e. small molds conventionally suitable for ingots to make bar products, for example molds on the order of 6 to 10 tons capacity having horizontal dimensions of less than about 36 inches (less than 9 sq. ft. in section). In each case, the mold is first filled to about 80% to 95%, a skin or shell of steel being allowed or caused to solidify next to the mold wall. Although teeming may be interrupted, even for one to five minutes, to insure solidification of such a skin, it is found that with the non-rimming steel and especially in the small ingot molds appropriate for bar stock, a sufficient, solid shell or skin has been formed by the time the mold is 80 to 95% full so that no actual interruption of teeming is needed. In either case, teeming is continued with the same molten steel, but with simultaneous addition of aluminum, as be directing the latter into the falling stream of steel; such additional material may not only be specifically aluminum, but may also consist of one or more other elements, such as silicon, sulfur, copper, boron, columbium, vanadium, titanium, phosphorus and rare earths. As a result, the ingot mold is filled and the core, still molten, contains the desired amount of aluminum, plus such other elements as may be wanted. Ordinarily, the aluminum, added so that the amount in the core will represent 0.02 to 0.5%, will have functioned to kill the steel throughout the core. It may also be sufficient to have a grain-refining function if desired.

A further aspect of the invention is a preferred compositional adjustment or control of the base melt, i.e. in the furnace or otherwise prior to pouring from the ladle (and before the above addition of aluminum) such that so-called blow holes do not form at or near the skin of the ingot. In particular, this result may be accomplished by providing enough deoxidation in the base melt for such purpose while the deoxidation is kept insufficient for killing the steel. Thus, if the silicon content is adjusted to be in the range of 0.03 to 0.15% or the aluminum in the range of 0.005 to 0.01%, the deoxidation is ordinarily sufficient to inhibit formation of blow holes at or near the ingot surface.

As will be understood, the completed ingot, with the aluminum-treated and presumably aluminum-killed core, is processed in conventional manner for killed steel. After solidification, it is rolled to bloom or other shape and ultimately to the desired products in this invention, although the steel could conceivably be used for other hot rolled materials such as hot rolled strip or plate.

The products, having a defined base composition stated hereinabove, together with the core having an aluminum content sufficient to constitute the product as killed or grain refined, or both, are new, especially in that the skin covering the principal surface of bars of various cross-sectional shapes contains little or no aluminum, or other additions (as of elements mentioned above for possible inclusion during back-filling) that might produce surface defect problems. At the same time, the non-killed steel is preferably sufficiently deoxidized so that formation of blow holes at the surface is avoided. The allowable surface defects on a finished bar product are dictated by specification, which is ordinarily met by conditioning, i.e. grinding or scarfing the bloom or billet material, from which the bar is rolled, to remove surface defects before production of the finished hot roller bar. If the defects are too severe to be removed economically, the entire bloom or billet is scrapped. This invention reduces the amount and/or severity of defects in the bloom, billet or slab, minimizing rejections and reducing the conditioning required; hence the yield of final bar product per ton of melted steel is increased and the cost of conditioning is reduced.

Further description of the invention and of various specific features will appear in the following detailed description.

DETAILED DESCRIPTION

As explained above, the basis for the present steel may be a steel melt prepared in a conventional manner, e.g. in a furnace process of the basic oxygen type, with various elements added in the furnace or ladle according to the customary techniques. For example, the following are some of the many examples of standard steel compositions that are suitable, in weight percent (as elsewhere herein):

TABLE 1

| Grade No. | C | Mn | Si | Ni | Cr | Mo |
|---|---|---|---|---|---|---|
| 8620 | 0.18–0.23 | 0.7–0.9 | 0.2–0.35 | 0.4–0.7 | 0.4–0.6 | 0.15–0.25 |
| 4118 | 0.18–0.23 | 0.7–0.9 | 0.2–0.35 | — | 0.4–0.6 | 0.08–0.15 |
| 4340 | 0.38–0.43 | 0.65–0.85 | 0.2–0.35 | 1.65–2.0 | 0.7–0.9 | 0.02–0.3 |
| 1023 | 0.2–0.25 | 0.3–0.6 | — | — | — | — |

For this invention, the silicon content of the base melt is kept at or below 0.15%, and the remainder where desired (as in some of the above compositions) is added specially at a later stage.

None of the foregoing, or indeed any steel within the general composition ranges stated elsewhere herein, is a rimming steel; i.e. it cannot be rimmed, in the sense of the effervescence of gas-releasing function that occurs in the molten metal when it is first poured into an ingot mold. The chief characteristic responsible for the non-rimming state is the carbon content, e.g. 0.15% or more, although the melt, desirably for some purposes of the present products, may also contain too much manganese, as in the range upwards of 0.8%, e.g. 0.8% to 1.75% Mn. As will be understood, the present invention is concerned with improvement in steels in which these higher concentrations of carbon, and also manganese, may be required for strength, toughness, hardness or other properties, and which may also be desired to include substantial contents of alloying elements such as Ni, Cr, Mo, and perhaps lesser amounts of other additions, for instance, one or more of Si, B, Cb, V, Ti, P and rare earths, and particularly Al, the elements of this last-mentioned group being incorporated in a special manner (not in the base melt) pursuant to the invention.

Although the base melt is neither rimmed nor killed, it is preferably so treated or adjusted in composition that blow holes near the surface of the solidified ingot are inhibited or avoided. This result can be achieved by limited deoxidation with silicon or aluminum, preferably by addition to or adjustment in the ladle, as in amounts of 0.03 to 0.15% Si or 0.005 to 0.01% Al. Alternatively, both elements may be included, e.g. in appropriately lesser quantities, or deoxidation may be obtained with other elements such as calcium (in limited amount for this purpose, as will be known) or by inclusion of sufficient carbon or manganese, e.g. as using the higher portion of the total general ranges of one or both of these elements as given herein. The steel, at least after it reaches the ladle or is first poured, is thus in partially killed state because of having sufficient deoxidation to prevent formation of blow holes (e.g. at or in the skin) but insufficient to be fully killed. Such condition, and modes of obtaining it, can be considered to be well known or understood in the art, and is amply defined by the term partially killed or by specifying deoxidation produced by or equivalent to a content of 0.03 to 0.15% Si or 0.005 to 0.01% Al.

Stated more explicitly, the general ranges of elements constituted essentially in a base steel suitable for the invention, as well as certain presently preferred ranges by way of example, are as follows (with exceptions noted below), the balance in each case being iron and incidental elements, all in weight percent:

TABLE 2

| | C | Mn | Ni | Cr | Mo | S | P |
|---|---|---|---|---|---|---|---|
| Broad range | 0.15–0.9 | 0.3–1.75 | 0–2.0 | 0–1.0 | 0–0.5 | 0.045 max. | 0.04 max. |
| Special range as example | 0.18–0.45 | 0.3–0.9 | 0–2.0 | 0–1.0 | 0–0.25 | 0.045 max. | 0.04 max. |

As explaind above, the composition as poured is preferably in partially killed state, e.g. with inclusion of silicon or aluminum in the limited ranges mentioned. It will also be understood that except regarding present preference for the above example, there is no particular correlation between the quantities of carbon and manganese, i.e. only as practice may dictate; for instance, a steel having selected suitability may need a higher Mn content (say, 1.0 to 1.75%) with carbon below 0.45%, or the requirement for a steel of 0.5 to 0.9% C may utilize manganese in the lower range, as 0.3 to 0.6%. In general, selection of specific compositions can follow standard or recognized criteria for particular uses, especially as desired for steel bars.

In making the ultimate product, the base molten steel as described above, advantageously partially killed, is teemed from the ladle into the ingot mold. Each mold is first filled about 80 to 95% full (e.g. 90%) under circumstances (either by allowing the mold to stand, up to a few minutes or more, preferably without so doing) such that a skin or shell solidifies against the inside wall of the mold. Thereupon teeming of the same molten steel is continued to fill the mold completely (i.e. back-filling) while additional elements are added as desired. As will be understood, if necessary a plurality of molds can be partly filled in rapid succession, and the ladle can be returned for the back-filling step to the same molds.

During the back-filling, i.e. completion of filling, aluminum is added to the molten core in the mold, advantageously adding it as metallic aluminum or ferro-aluminum, in divided, solid form (e.g. pieces not bigger than about ¼ inch) to the stream descending from the ladle. Such injection into the molten steel stream may begin with the completion stage and be arranged to be finished just before the end of all filling. There should be sufficient aluminum added to make the total amount in the completed ingot, i.e. in its core metal, of a desired value. Ordinarily, the resulting steel of the core thus becomes fully killed (aluminum killed), and further desired effects such as grain refinement may also be achieved, in accordance with known practices and functions of aluminum in steel. At the same time as the aluminum is added, other elements may be incorporated in the molten core, for example for strengthening purposes (silicon, columbium, vanadium, titanium, boron), avoidance of directionality in mechanical properties (rare earths such as cerium, lanthanum and the like), corrosion resistance (copper) and miscellaneous functions (sulfur, phosphorus). These elements are preferably injected into the falling stream of steel in the same way, as solid pieces, either of the selected element or of ferro-alloys or other compositions of such elements or mixtures, as may be suitable.

Thus, elements so added during back-filling may be such and in such amount as to provide the core with the following total content, including any amounts already present in the basic melt, in weight percent:

TABLE 3

| Al | Si | Cu | B | Cb | V | Ti | Rare Earths | Max. % S | P |
|---|---|---|---|---|---|---|---|---|---|
| 0.02–0.5 | 0–0.5 | 0–2.0 | 0–0.05 | 0–0.15 | 0–0.3 | 0–0.4 | 0–0.05 | 0.40 | 0 to 0.2 |

For killed steel, an aluminum content of 0.02–0.2% usually suffices, and for many steels silicon will be in a range up to 0.2%, and there will be 0.045 max. % S and 0.035 max. % P. In all cases, the ultimate solid product will have a skin or surface zone as defined in and with Table 2, and a core as further defined (i.e. modifying the base steel of the skin) in Table 3.

It will be understood that techniques and devices are available for feeding particles, granules or other pieces of the added metals, compounds or alloys into the falling stream of molten metal, or alternatively, directly into the metal in the mold as and preferably where the steel is teemed in.

The metal filling the ingot mold, after the above back-filling, is allowed to solidify and is thereafter processed in manner suitable for killed steel, and may be reduced by hot rolling, e.g. to blooms and billets, and ultimately to the desired shapes, which are here contemplated to be bars (round, rectangular or other), or of course can be hot rolled strip or plate if the composition is suitable. Conditions for all such hot rolling may be as known or readily determinable for steels of the nature and composition finally attained in the ingot core. As will now be appreciated, the rolled products attain the unusual and highly desirable results described above, having a non-rimmed and at most only partially killed skin (e.g. of about ½ to 4 inches thickness around the ingot and about 0.001 to 0.100 inch around the bar or other products), which provides very good surface properties, while the steel is functionally and usefully equal to that of the core, with advantages of fully killed condition and further properties attributable to such content of alloying or other useful additives as it may have. The steel is specially characterized by absence of surface or near-surface difficulties (whether of inclusions, blow holes or other nature), that are normally of concern in ingots, blooms and billets to be used in the manufacture of bar products.

As a further example of the invention, experimental commercial-size ingots were cast in 6-ton molds, 25 inches×27 inches in cross-section, following the above described practice, i.e. first filling each mold about 85% full, allowing it to stand about one minute to solidify a skin, and then adding aluminum to the teeming stream of steel during back-filling. The ladle analysis of the base heat (balance iron) was (%) 0.22 C, 0.37–0.40 Mn, 0.03–0.04 Si, 0.03 Ni, 0.06 Cr, 0.01 Mo, 0.04 Cu, 0.007

Sn, 0.016–0.020 P, 0.016 S. During back-filling, 6 lbs. aluminum was added into the core of some molds, 4.2 lbs. Al in the core of others, and 15.6 lbs. of ferro-aluminum in the core of still others, respectively yielding core average aluminum contents (%) of 0.042, 0.041 and 0.063. The skin in each case contained less than 0.01% Al. All ingots were found to have exceptional surface properties, and as represented by the core metal, constituted killed steel having the mechanical, working and other properties of the base composition when killed. Billets from these ingots required very little surface conditioning and were successfully hot rolled to bar products.

Although the foregoing has primarily described the production of hot rolled bars (including rods), e.g. rectangular, round or other, the steel of the invention is also eminently suitable for bar products, likewise of a variety of shapes, produced by cold reduction. Specification as to surface character is likewise in such case met by conditioning of the original hot rolled billet or the like, and the invention is equally advantageous in reducing the needed extent of such treatment. As will be understood, for example, cold down bar products are usually produced from hot rolled bar products, e.g. a hot rolled bar or rod, by known, conventional procedure, so that the surface requirements of the cold reduced products are expected to be satisfied by the hot rolled starting products and therefore in turn by the state of the original bloom or billet. In all cases, the principal surfaces of product bars, meaning the chief and usually all longitudinal bar surfaces, are in excellent condition. Respecting the above example, later tests showed the delay before back-filling to be necessary.

It is explained that for the purpose of this invention, steel containing 0.15% carbon or more is considered non-rimming, especially having regard to the further condition of the bar steel herein as partially killed, i.e. sufficiently deoxidized to inhibit formation of blow holes. Thus, even though in other circumstances of molten steel, carbon in the neighborhood of 0.15% may not be sufficient of itself to preclude the effervescent action of rimming, the carbon content is significant and the situation of the melt can be such that at 0.15% C, notably at levels above such value, and most definitely at 0.18% C or more, the steel is non-rimming.

It is to be understood that the invention is not limited to the specific compositions and steps hereinabove set forth but may be carried out in other ways without departure from its spirit.

We claim:

1. A non-rimming steel bar product that has been shaped by rolling deformation and that has a non-rimmed steel skin over its principal surface, said skin having a partially killed composition consisting essentially of 0.18 to 0.45% C, 0.3 to 1.75% Mn, 0.04 max. % P, 0.045 max. % S, 0 to 2.0% Ni, 0 to 1.0% Cr, 0 to 0.5% Mo, balance iron and incidental elements, said partially killed composition being sufficiently deoxidized by inclusion of material of the class consisting of silicon and aluminum to prevent formation of blow holes at or in said skin, said included material being present in an amount of not more than 0.15% Si or 0.010 Al insufficient to constitute the composition as killed steel, and a core of non-rimming steel under said skin which is aluminum-treated to be killed or grain refined and which consists essentially of the aforesaid composition plus other material to provide 0.02 to 0.5% Al, 0 to 0.5% Si, 0.40 max. % S, 0 to 2.0% Cu, 0 to 0.05% B, 0 to 0.2% P, 0 to 0.15% Cb, 0 to 0.3% V, 0 to 0.4% Ti, 0 to 0.05% rare earth elements, said bar product being produced by rolling from an ingot having a surrounding layer ½ to 4 inches thick which has the first-mentioned partially killed composition and the aforesaid skin of said bar product derived from said layer being 0.001 to 0.100 inch thick.

2. A steel bar product as defined in claim 1, in which the skin and core contain 0.3 to 0.9% Mn.

3. A steel bar product as defined in claim 1, in which the skin and core contain 1.0 to 1.75% Mn.

4. A steel bar product as defined in claim 1, in which the core contains 0.02 to 0.2% Al.

5. A steel bar product as defined in claim 1, shaped by hot rolling, followed by cold rolling.

* * * * *